US005666935A

United States Patent [19]

Kato

[11] Patent Number: 5,666,935

[45] Date of Patent: Sep. 16, 1997

[54] FUEL INJECTION CONTROL FOR ENGINE

[75] Inventor: Masahiko Kato, Hamamatsu, Japan

[73] Assignee: Sanshin Kogyo Kabushiki Kaisha, Hamamatsu, Japan

[21] Appl. No.: 545,409

[22] Filed: Oct. 19, 1995

[30] Foreign Application Priority Data

Oct. 19, 1994 [JP] Japan ..... 6-253706

[51] Int. Cl.[6] ..... F02D 41/14

[52] U.S. Cl. ..... 123/687; 123/694

[58] Field of Search ..... 123/693, 694, 123/687

[56] References Cited

U.S. PATENT DOCUMENTS 4,462,366 7/1984 Nomura et al. ..... 123/694
4,463,594 8/1984 Raff et al. ..... 123/694 X
4,625,698 12/1986 Jamrog ..... 123/696
4,767,520 8/1988 Asakura et al. ..... 123/693 X
4,913,121 4/1990 Shimomoura et al. ..... 123/681

FOREIGN PATENT DOCUMENTS 57-41444 3/1982 Japan ..... 123/694

*Primary Examiner*—Tony M. Argenbright
*Attorney, Agent, or Firm*—Knobbe, Martens, Olson & Bear LLP

[57] ABSTRACT

A feedback control system for an internal combustion engine, particularly as utilized in an outboard motor. An oxygen sensor outputs a signal indicative of the fuel-air ratio for controlling the charge-forming system of the engine to maintain the desired fuel-air ratio. A series of filters, each tuned for a different frequency and a different engine speed, are interposed between the sensor and the control for reducing the effect of noise.

16 Claims, 6 Drawing Sheets

FUEL INJECTION CONTROL FOR ENGINE

BACKGROUND OF THE INVENTION

This invention relates to a control for an engine and more particularly to a feedback control for the fuel injection system of an engine.

In the interest of fuel economy, better engine performance and overall emissions control, a wide variety of types of feedback control systems have been proposed for controlling the fuel-air ratio of the engine. By appropriately controlling the fuel-air ratio, exhaust emissions can be effectively reduced and fuel economy and engine performance increased.

These types of feedback control systems generally employ a sensor in either the combustion chamber or in the exhaust system that provide a signal indicative of the fuel-air ratio under which the engine is operating. By using this signal, a feedback control controls the air and/or the fuel supply circuits so as to maintain the desired fuel-air ratio. Oxygen sensors are frequently employed for this purpose.

Regardless of the type of sensor employed, the sensors, which are all generally electrical in nature or cooperate with electrical circuits to provide electrical signals for processing, are subject to noise. The noise gives output signals, which may be erratic and not actually indicative of the actual engine conditions.

In order to avoid these problems, which may be particularly acute at certain specific engine running conditions, the ECU or control circuit has been provided with some mechanism whereby the signals are averaged so as to reduce the effect of the noise. However, these systems are not totally effective.

It is, therefore, a principal object of this invention to provide an improved internal combustion engine and control system therefor wherein feedback control can be more accurate.

It is a further object of this invention to provide an internal combustion engine and control therefor wherein the output signal of the fuel-air ratio sensor is filtered under some running conditions to reduce the effect of noise.

SUMMARY OF THE INVENTION

This invention is adapted to be embodied in an internal combustion engine and method of operating an engine. The engine includes at least one combustion chamber, an induction system for delivering an air charge to the combustion chamber, and a charge-forming system for delivering a fuel charge to the combustion chamber. The fuel-air mixture in the combustion chamber is ignited and is discharged to the atmosphere through an exhaust system. A sensor is provided for sensing the fuel-air ratio, and it outputs its signal to a feedback control. The feedback control controls at least one of the charge-forming system and the induction system to maintain the desired fuel-air ratio in response to the output of the sensor.

In accordance with an engine embodying the invention, the feedback control includes a filter for filtering certain frequencies of the output of the sensor under at least certain engine running conditions.

In accordance with a method for practicing the invention with an engine as described, the output of the sensor is filtered to remove certain frequencies at certain engine running conditions.

DETAILED DESCRIPTION OF THE PREFERRED EMBODIMENTS OF THE INVENTION

Figure 1:
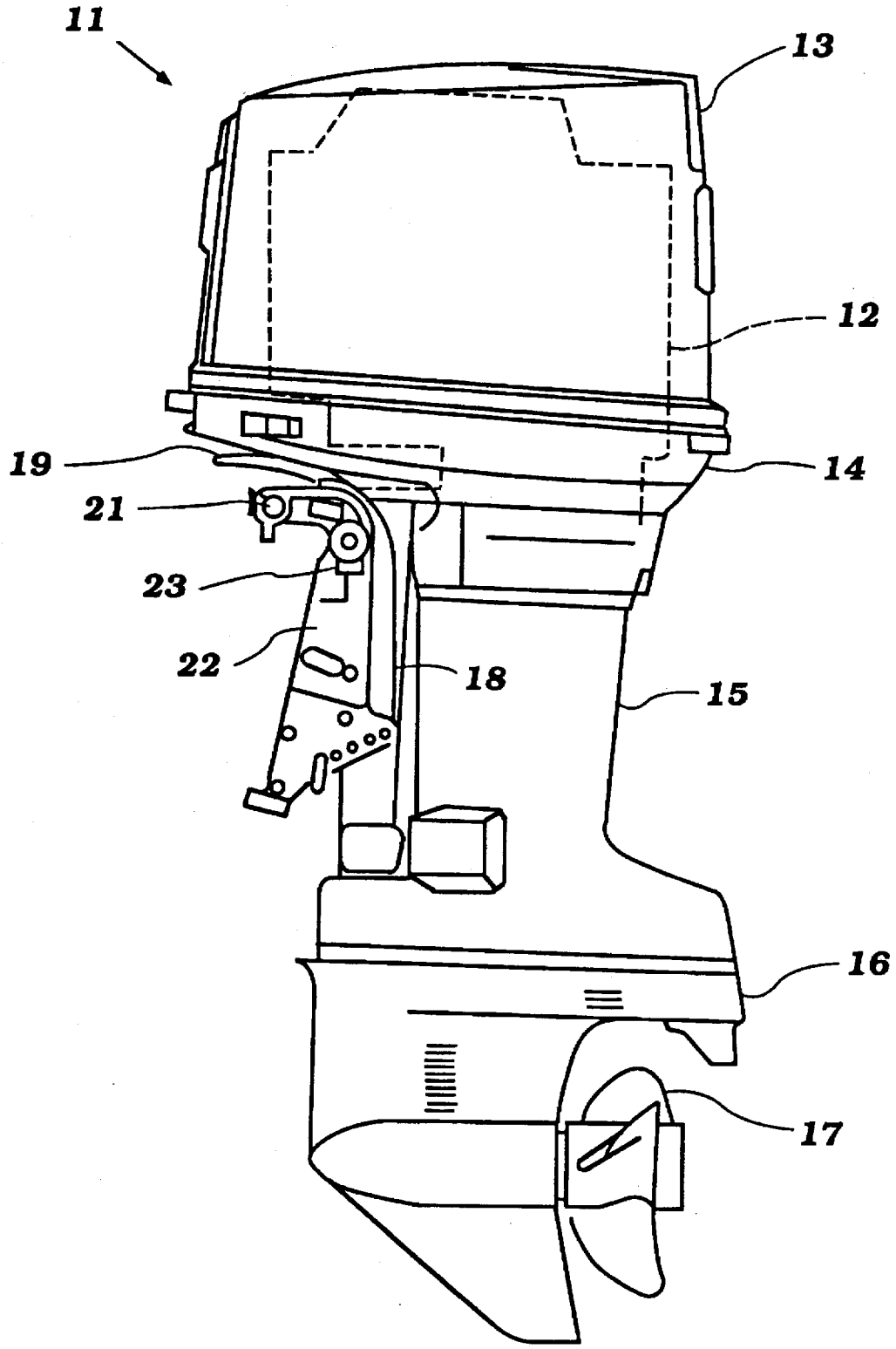
FIG. 1 is a side elevational view of an outboard motor constructed and operated in accordance with an embodiment of the invention.

Referring now in detail to the drawings and initially to FIG. 1, an outboard motor constructed and operated in accordance with the embodiment of the invention is indicated generally by the reference numeral 11. The invention is described in conjunction with an outboard motor because an outboard motor is a typical environment in which the invention may be utilized. It will be readily apparent to those skilled in the art, however, how the invention may be employed with a wide variety of types of engines and engine applications. Therefore, the description of the engine which follows should also be considered as exemplary of one of many types of engines with which the invention may be practiced.

The invention depicted and its application to an outboard motor have been chosen because the invention has particular utility with two-cycle crankcase compression engines. This is the type of engine which will be described, and such engines are frequently employed as the power plants in outboard motors. Again, however, those skilled in the art will readily understand that this is merely for purposes of explanation.

The outboard motor 11 is comprised of a power head that consists primarily of a powering internal combustion engine 12 that is surrounded within a protective cowling that is comprised of a main cowling member 13. This cowling also includes a tray portion 14 which underlies in part the engine 12.

As is typical with outboard motor practice, the engine 12 is supported within the power head so that its output shaft or crankshaft rotates about a generally vertically extending axis. This is done to facilitate connection between the engine output shaft, which will be described later by reference to the remaining figures, and a drive shaft (not shown) that depends into a drive shaft housing 15 that is positioned beneath the power head. This drive shaft continues on and terminates in a lower unit 16 formed at the lower portion of the drive shaft housing 15.

Contained within the lower unit 16 and driven by the drive shaft is a conventional forward/neutral/reverse transmission, which is also not shown. This transmission is coupled to a propeller 17 in a well-known manner so as to permit driving of the propeller 17 in selected forward or reverse directions.

The outboard motor further includes a steering shaft (not shown) which is rotatably journaled within a swivel bracket 18 for steering of the outboard motor 11 about a generally vertically extending steering axis. A tiller 19 is affixed to the upper end of the aforenoted steering shaft and is operated in a known manner for steering of the outboard motor 11 and the associated watercraft.

The swivel bracket 18 is pivotally connected by means of a pivot pin 21 to a clamping bracket 22. The clamping bracket 22 is adapted to be attached to the transom of an associated watercraft in a manner well known in this art. The pivotal movement of the swivel bracket 18 and, accordingly, the major portions of the outboard motor 11 about the pivot pin 21, accommodates both trim adjustment of the angle of attack of the propeller 17 and also movement of the outboard motor to an above-the-water tilted-up position.

A trim position sensor 31 is interposed between the swivel bracket 18 and clamping bracket 22 to provide an output signal indicative of the trim condition. This trim signal may be utilized to provide an indication to a remote operator of the watercraft of the trim position and also for various control purposes, including engine control, if desired.

Figure 2:
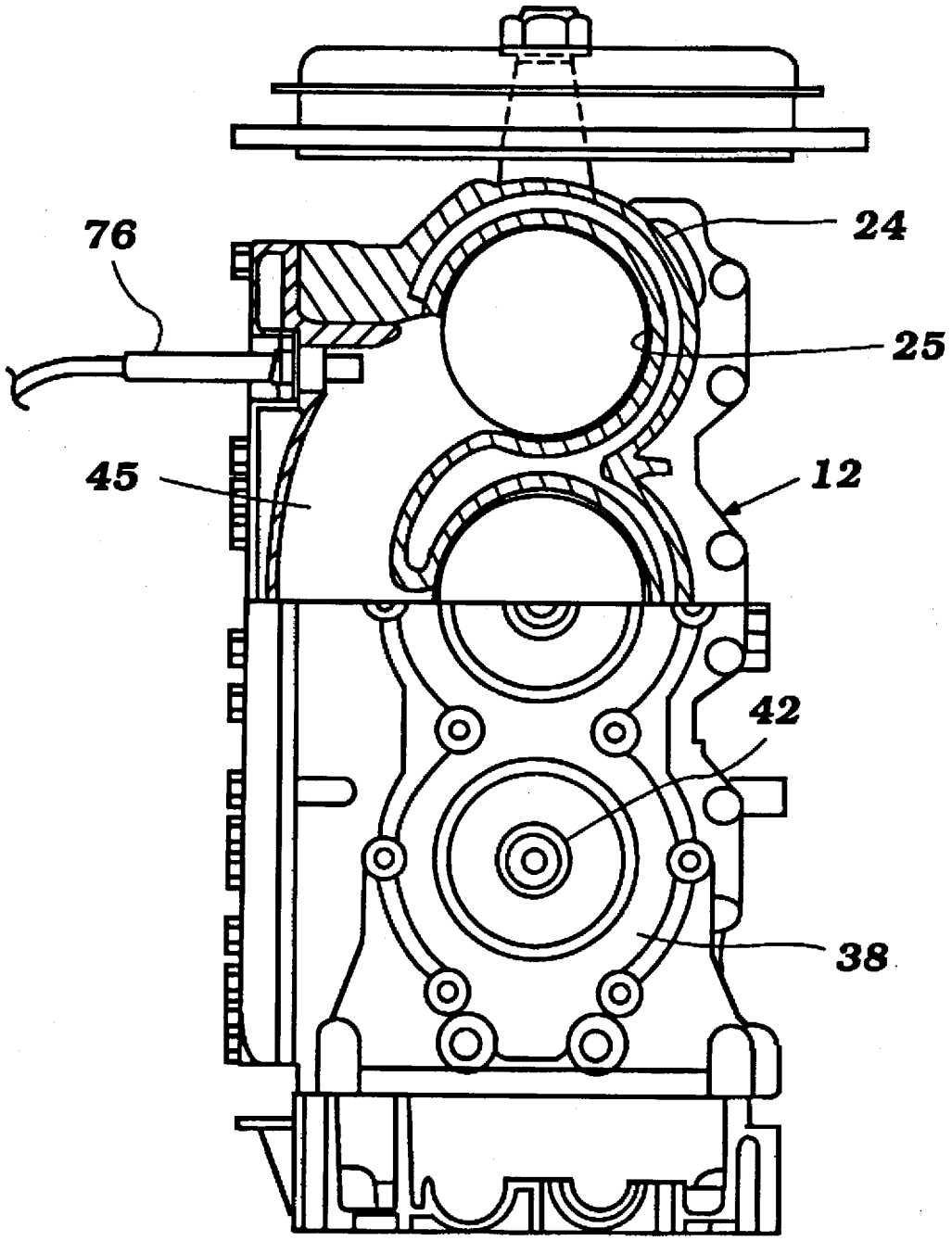
FIG. 2 is a rear elevational view of the engine of the power head, with a portion broken away and shown in section.
Figure 3:
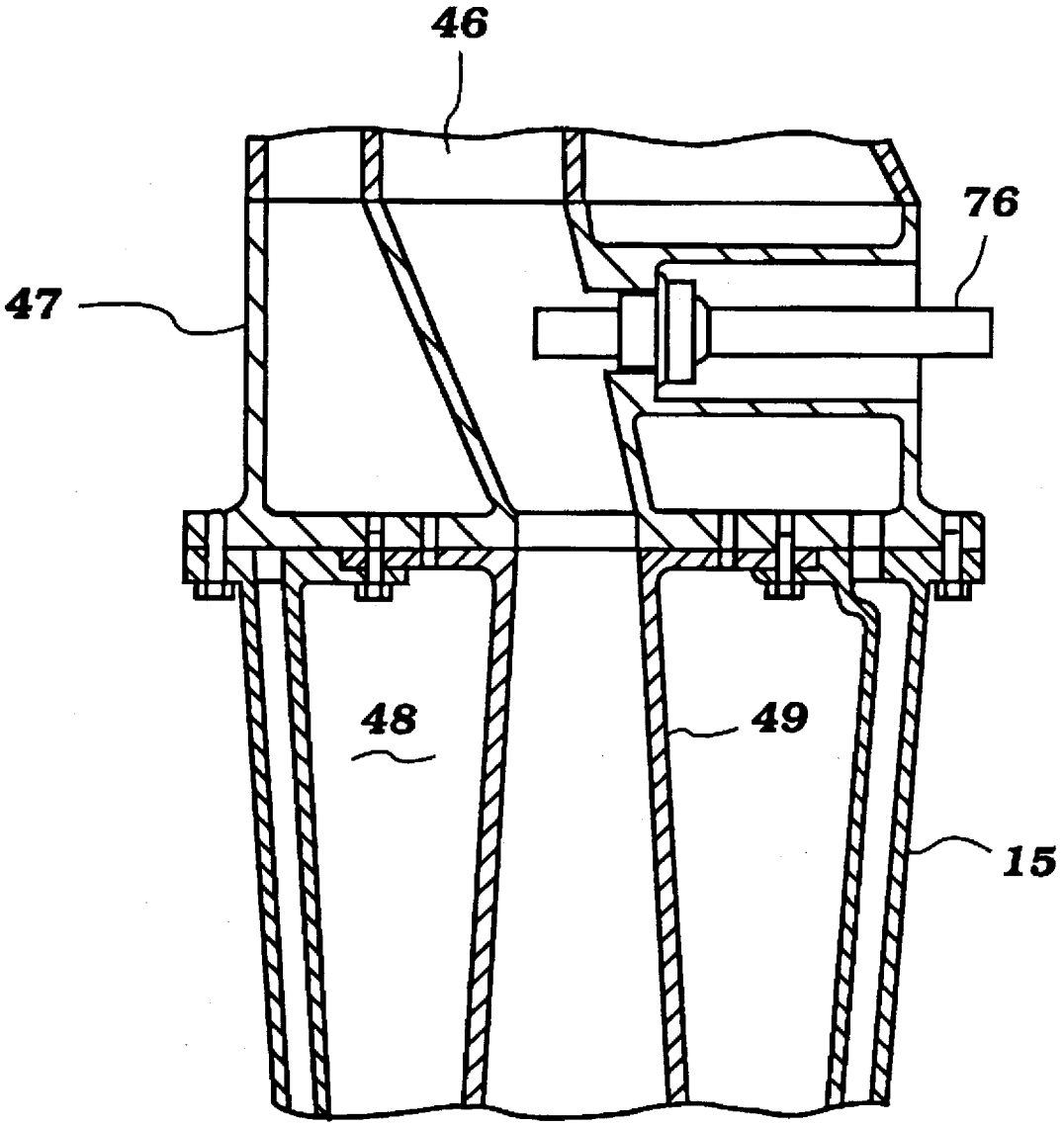
FIG. 3 is an enlarged cross-sectional view showing the area where the power head meets the drive shaft housing and shows the exhaust system and sensor therein.
Figure 4:
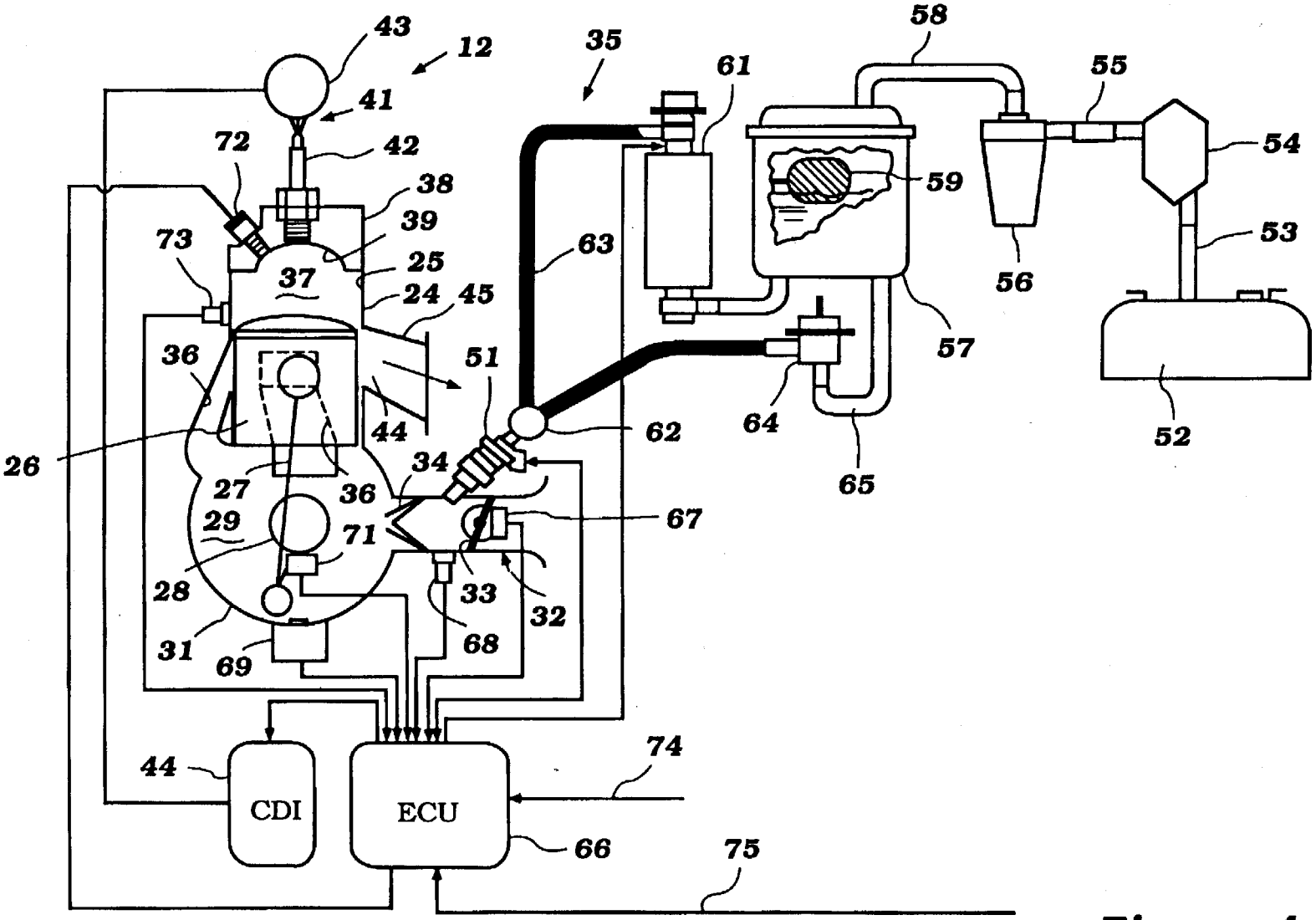
FIG. 4 is a partially schematic cross-sectional view taken through one cylinder of the engine and shows the various components of the engine and its control system in part schematically.

Referring now additionally to FIGS. 2–4 and primarily to these figures, the engine 12 and the systems associated with it are shown in more detail and, at times, schematically. In the illustrated embodiment, the engine 12 is of the three-cylinder in-line type, although it will be readily apparent to those skilled in the art how the invention may be practiced in other types of engines and engines having other cylinder numbers and other cylinder configurations.

FIG. 2, as has been noted, is a rear elevational view of the engine, with a portion broken away, while FIG. 4 is a schematic view of the engine showing one of its cylinders. Although the internal construction of the engine may be of any known type, these components will be described briefly.

The engine 12 includes a cylinder block 24 in which three aligned cylinder bores 25 are formed. In each of the cylinder bores 25 a piston 26 reciprocates. The pistons 26 are coupled by means of a connecting rods 27 to a crankshaft 28. The crankshaft 28 is thus driven by the pistons 26 through the connecting rods 27 in a manner well known in this art.

The crankshaft 28 is rotatably journaled within a crankcase chamber 29 formed by the cylinder block 24 and a crankcase member 31 that is detachably connected to it. As is well known in crankcase compression engines, the crankcase chamber 29 associated with each of the cylinder bores 25 is sealed from the others.

The engine 12 is provided with an induction system for delivering an air charge to the crankcase chambers 29. This induction system is indicated generally by the reference numeral 32 and is shown only schematically, since the actual details of it may be of any type known in the art. The induction system includes an inlet device in which a flow-controlling throttle valve 33 is provided. The throttle valve 33 is remotely controlled by an operator and controls the volume of air which can pass through the induction system 32.

This air that has passed the throttle valve 33 enters the crankcase chambers 29 through an intake manifold in which a reed type check valve 34 is positioned. This check valve 34 permits air flow into the crankcase chambers 29 when the pistons 26 are moving upwardly and precludes reverse flow when the pistons 26 move downwardly to compress the charge in the chambers 29.

In the illustrated embodiment, a fuel charge-forming system, indicated generally by the reference numeral 35, is provided for supplying fuel to the air inducted. Although the invention is described in conjunction with such a manifold injection system, it will be readily apparent to those skilled in the art that the invention may be employed with other types of charge-forming systems, including those embodying direct cylinder injection. The fuel supply system 35 will be described in more detail later.

The air charge and fuel, if any, admitted to the crankcase chambers 29 and compressed therein during the downward movement of the pistons 26 is transferred through one or more scavenge passages 36 to combustion chambers 37, which are formed in part by the cylinder bore 25 and pistons 26. In addition, a cylinder head assembly 38, shown in more detail in FIG. 2, is affixed to the cylinder block 24 in a known manner. The cylinder head 38 has individual recesses 39 which cooperate with the elements of the combustion chamber 37 thus far described to complete the combustion chamber.

The charge which has been admitted to the combustion chamber 37 is fired by means of an ignition system, indicated generally by the reference numeral 41. This ignition system includes individual spark plugs 42 mounted in the cylinder head 38 and having their gaps extending into the combustion chambers 37. In the illustrated embodiment, each spark plug 42 has associated with it a respective spark coil 43 that receives an electrical charge from a capacitor discharge ignition system (CDI) 44 for firing the spark plugs 42 in a well-known manner.

The charge will burn and expand and drive the pistons 26 downwardly. When the pistons 26 move downwardly a sufficient distance, they will open exhaust ports 44 of an exhaust system that includes an exhaust manifold 45 that is shown schematically in FIG. 4, but which is shown in actual detail in FIG. 2. The exhaust manifold 45 is formed integrally with or at least partially by the cylinder block 24 and terminates in a downwardly facing discharge end 46, shown in FIG. 3. This discharge mates with the exhaust passage of an exhaust guide 47 that is interposed between the lower end of the cylinder block 24 and the upper end of the drive shaft housing 15.

The drive shaft housing 15 is formed with an integral expansion chamber 48, to which the exhaust gases are delivered. For this purpose, an exhaust pipe 49 is affixed to the underside of the exhaust guide 47 and opens into the expansion chamber 48. The expansion of the exhaust gases in the expansion chamber 48 provides some silencing. The exhaust gases are then discharged to the atmosphere through any suitable exhaust system.

In connection with outboard motor applications, this exhaust system may include a through-the-hub underwater exhaust gas discharge formed in the propeller 17. In addition, and as is typical in this art, there may also be provided an above-the-water exhaust gas discharge for discharging the exhaust gases in an area of reduced back pressure when the outboard motor 11 is operating at a slow speed and the propeller 17 is relatively deeply submerged. These types of systems are well known in the art, and any known type of system may be employed in conjunction with the invention.

Returning now to the description of the fuel supply system 35 by particular reference to FIG. 4, a plurality of electronically actuated fuel injectors 51 are provided, each of which discharges into the throttle body or induction system downstream of the throttle valves 33. The fuel injectors are operated in a manner to be described so as to control the timing and duration of fuel injection.

Fuel is supplied to the fuel injectors 51 by the charge-forming system 35, which includes a remotely positioned fuel tank 52 which may be positioned in the hull of an associated watercraft. A conduit 53 supplies fuel from the tank 52 to the power head, and specifically to a low-pressure fuel pump 54 which is mounted on the engine 12 and driven in any suitable manner.

The low-pressure fuel pump 54 discharges fuel through a conduit 55 to a fuel filter 56. The fuel filter 56, in turn, delivers the fuel to a vapor separator 57 through a conduit 58. The vapor separator 57 has a float-operated valve 59 that controls the level of fuel therein, and which thus provides a uniform head of fuel to a high-pressure fuel pump 61. Although the fuel pump 61 is shown schematically as an external component, the fuel pump 61 may, in fact, be contained within the vapor separator 57. The vapor separator 57 has a vent pipe (not shown) by which fuel vapors may be discharged, preferably back into the engine for further combustion therein.

The high-pressure fuel pump 61 may be electrically driven and delivers fuel to a fuel rail 62 through a conduit and/or manifold 63. The pressure in the fuel rail 62 is controlled by a pressure regulator 64, which controls the fuel pressure by dumping excess fuel back to the vapor separator 57 through a return line 65. In this way a uniform, controlled pressure source of fuel is available for the fuel injectors 51.

The controls for both the ignition system 41 and charge-forming system 35 will now be described again by primary reference to FIG. 4. Both the CDI unit 44 and the electronically controlled fuel injectors 51 are controlled by an ECU, indicated generally by the reference numeral 66. The ECU 66 receives a number of signals from both engine conditions and ambient conditions, and some of these signals will be described. It is to be understood, however, that the actual control strategy that is adopted may be of any known in this art or any other suitable type.

The invention deals with one of the sensors, the combustion sensor, and its interrelationship, which will be described later. Therefore, the sensors now to be described should be considered to be only typical sensors and systems with which the invention may be practiced.

Associated with the throttle valve 33 is a throttle position sensor 67 that outputs a signal to the ECU 66, which is indicative of the operator power demand indicated by the position of the throttle valve 33. Also provided is an intake air temperature sensor 68 that is positioned in the induction system 32 downstream of the throttle valve 33.

As is well known, intake air volume in two-cycle engines may be measured accurately by measuring crankcase pressure at certain crank angles. This system is employed in the illustrated embodiment, although others may be employed, as will be apparent to those skilled in the art. Therefore, there is provided a crankcase pressure sensor 69 that senses the pressure in the crankcase chamber 29. Also, a crank angle position sensor 71 is associated with the crankshaft 28 and outputs a signal indicative of the angular position of the crankshaft 28. This signal also may be employed for controlling the timing of spark timing and the timing of fuel injection, as is well known in the art. In addition, the output of this sensor 71 with time may be employed to measure actual engine speed.

There is further provided an in-pressure cylinder pressure sensor 72 that senses the pressure in the combustion chamber 37. This signal as well as a signal from a knock sensor 73 are transmitted to the ECU 66 for its control purposes. Other signals may also be transmitted, such as a position sensor for the controller of the throttle valve 33, indicated schematically at 74, and the output of the various other signals such as intake water temperature, exhaust back pressure, output of the combustion condition sensor, to be described, and other such conditions that may effect engine performance which output is indicated schematically at 75.

Finally, and in accordance with the invention this latter sensor is provided for sensing the actual fuel-air ratio in the combustion chamber. This sensor outputs a signal to the ECU that is employed to maintain the desired fuel-air ratio, such as a stoichiometric ratio. The sensor that performs this function is, in the illustrated embodiment, an oxygen ($O_2$) sensor that will output a signal indicating either a rich or lean mixture. This sensor is identified by the reference numeral 76 and may be positioned either in the exhaust manifold 45, as shown in FIG. 2, or in the exhaust passage formed in the exhaust guide 47, as shown in FIG. 3. In either event, the oxygen sensor 76 should be disposed in an area where it can sense the combustion products at a time when combustion has been substantially completed and before any scavenging fuel-air charge may have been mixed with the combustion products.

The actual feedback control strategy employed may be of any type known in the art. However, the output of the oxygen sensor 76 is influenced very strongly by noise, as may be seen in FIG. 5, wherein the actual output signal is indicated by the curve A. In this figure the running condition is a low-speed, idle, or trolling condition. It will be seen that the curve A has many spikes, and these are caused primarily by electrical interference or "noise." Systems have been proposed wherein the ECU 66 is provided with some form of averaging arrangement so that an output signal like the signal B will result. However, and as should be readily apparent, this signal is also quite erratic and does not permit good feedback control because of the electrical noise that is being experienced.

Figure 5:
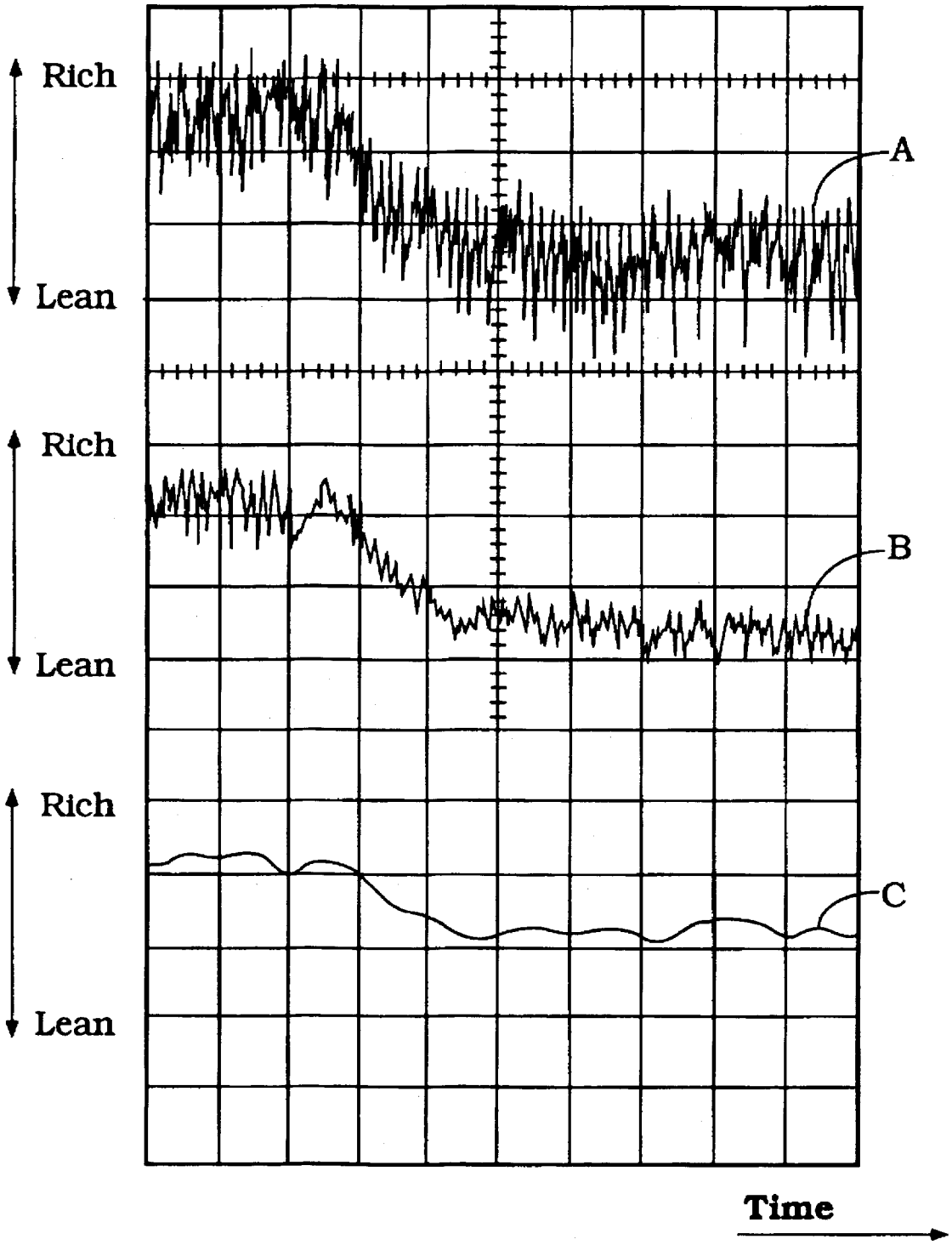
FIG. 5 is a graphical view showing the output of the combustion sensor with respect to time as the curve A, a computer damped output as shown by the curve B, and the filtered output in accordance with the invention as shown by the curve C.
Figure 6:
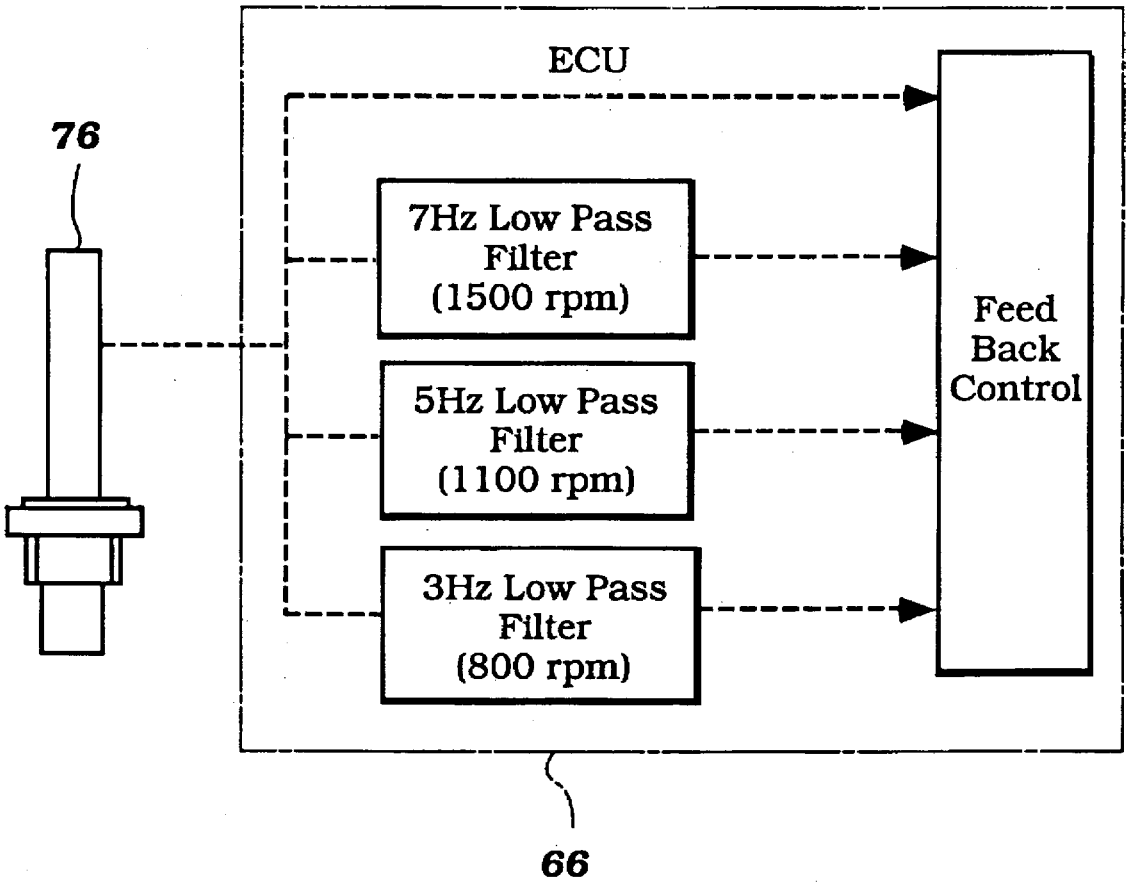
FIG. 6 is a schematic view showing the sensor filtering arrangement in the ECU.

In accordance with the invention, therefore, a system is provided as shown in FIG. 6 wherein there are provided a series of filters which function together so as to filter out the electrical noise and provide a much smoother output to the ECU, as shown by the curve C in FIG. 5.

Within the ECU there is provided three separate low-pass filters, which are operative at engine speeds of 800 rpm, 1100 rpm, and 1500 rpm, respectively. In the illustrated embodiment, these filters comprise 3 Hz, 5 Hz, and 7 Hz filters, respectively. Hence, at the respective speed, the respective filter will be employed, and the smoother curve C of FIG. 5 will result. This signal is then provided to the actual feedback control circuit.

From the foregoing description it should be readily apparent that the described system provides very good feedback control, particularly at low engine speeds, since the filter employed will substantially reduce noise which could otherwise cause erratic control. Of course, the foregoing description is that of a preferred embodiment of the invention, and various changes and modifications may be made without departing from the spirit and scope of the invention, as defined by the appended claims.

What is claimed is:

1. An internal combustion engine comprised of at least one combustion chamber, an induction system for delivering an air charge to said combustion chamber, a charge-forming system for delivering a fuel charge to said combustion chamber, the fuel-air charge in said combustion chamber being ignited therein, an exhaust system for discharging combustion products from said combustion chamber to the atmosphere, a nonlinear sensor for sensing when the fuel-air ratio changes between rich and lean, a feedback control for controlling at least one of said charge-forming and induction systems for maintaining the desired fuel-air ratio in response to the output of said sensor, and at least two fixed filters tuned for two different speeds for filtering the output from said sensor at at least some running conditions.

2. An internal combustion engine as in claim 1, wherein the fuel-air ratio is controlled by controlling the charge-forming system.

3. An internal combustion engine as in claim 2, wherein the charge-forming system comprises a fuel injector.

4. An internal combustion engine as in claim 3, wherein the fuel injector injects fuel into the induction system.

5. An internal combustion engine as in claim 1, wherein the sensor comprises an oxygen sensor.

6. An internal combustion engine as in claim 5, wherein the oxygen sensor senses the combustion product from the combustion chamber.

7. An internal combustion engine as in claim 6, wherein the oxygen sensor is positioned in the exhaust system.

8. An internal combustion engine as in claim 7, wherein the oxygen sensor is positioned in the exhaust system close to the point where the combustion chamber communicates with the exhaust system.

9. An internal combustion engine as in claim 1, wherein the running condition wherein the filter is employed is a low-speed condition.

10. An internal combustion engine as in claim 9, wherein there are provided a plurality of fixed filters each tuned for a specific speed.

11. An internal combustion engine as in claim 10, wherein the fuel-air ratio is controlled by controlling the charge-forming system.

12. An internal combustion engine as in claim 11, wherein the charge-forming system comprises a fuel injector.

13. An internal combustion engine as in claim 12, wherein the fuel injector injects fuel into the induction system.

14. An internal combustion engine as in claim 13, wherein the sensor comprises an oxygen sensor.

15. An internal combustion engine as in claim 14, wherein the oxygen sensor senses the combustion product from the combustion chamber.

16. An internal combustion engine as in claim 15, wherein the oxygen sensor is positioned in the exhaust system.

* * * * *